US009297538B2

(12) United States Patent
Hargrave et al.

(10) Patent No.: US 9,297,538 B2
(45) Date of Patent: Mar. 29, 2016

(54) OVEN DOOR LIGHTING

(75) Inventors: David C. Hargrave, Granger, IN (US); Allan G. Trowbridge, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1539 days.

(21) Appl. No.: 12/330,648

(22) Filed: Dec. 9, 2008

(65) Prior Publication Data

US 2010/0139638 A1 Jun. 10, 2010

(51) Int. Cl.

| | |
|---|---|
| ***F24C 15/00*** | (2006.01) |
| ***F24C 15/34*** | (2006.01) |
| ***F24C 15/04*** | (2006.01) |
| ***F24C 15/02*** | (2006.01) |
| *G09F 13/04* | (2006.01) |

(52) U.S. Cl.

CPC ..... *F24C 15/008* (2013.01); *F24C 15/02* (2013.01); *F24C 15/04* (2013.01); *G09F 2013/049* (2013.01)

(58) Field of Classification Search

CPC ..... F24C 15/02; F24C 15/04; F24C 15/008; G09F 2013/049

USPC ..... 126/200, 190, 21, 19 R

See application file for complete search history.

(56) References Cited

U.S. PATENT DOCUMENTS

| | | | | |
|---|---|---|---|---|
| 4,033,321 | A * | 7/1977 | Krebs | 126/198 |
| 4,041,930 | A * | 8/1977 | Katona | 126/198 |
| 4,436,776 | A | 3/1984 | Wojcik | |
| 4,505,685 | A | 3/1985 | Tischer et al. | |
| 5,552,664 | A | 9/1996 | Csoknyai et al. | |
| 5,555,654 | A * | 9/1996 | Hermann | 40/714 |
| 6,615,520 | B2 | 9/2003 | Landers, Jr. et al. | |
| 6,736,534 | B1 | 5/2004 | Fite | |
| 6,766,605 | B2 | 7/2004 | Emert | |
| 7,121,674 | B2 | 10/2006 | Kraus et al. | |
| 7,252,402 | B2 * | 8/2007 | Gotz et al. | 362/89 |
| 7,334,362 | B2 | 2/2008 | Bladt | |
| 2003/0079387 | A1 | 5/2003 | Derose | |
| 2003/0142510 | A1 | 7/2003 | Yongzhong | |
| 2003/0211288 | A1 | 11/2003 | Schottland | |
| 2004/0031234 | A1 * | 2/2004 | Emde | 52/786.11 |
| 2005/0257435 | A1 | 11/2005 | Rottcher | |
| 2006/0027230 | A1 * | 2/2006 | Jung | 126/200 |
| 2006/0176710 | A1 | 8/2006 | Meinke et al. | |
| 2007/0019424 | A1 | 1/2007 | Alexander | |
| 2007/0081423 | A1 | 4/2007 | Chien | |

FOREIGN PATENT DOCUMENTS

| | | | | |
|---|---|---|---|---|
| DE | 10347763 | A1 * | 5/2005 | G09F 13/18 |
| DE | 102008004995 | B3 * | 12/2008 | C03C 23/00 |
| JP | 10312495 | A | 11/1998 | |
| WO | 2004086098 | A2 | 10/2004 | |

* cited by examiner

*Primary Examiner* — William G Corboy

(57) ABSTRACT

Lighting for an oven door includes a light source and a design that is selectively illuminated by the light source. The light source is located in the oven door, and the design is etched in an oven door window.

2 Claims, 4 Drawing Sheets

OVEN DOOR LIGHTING

TECHNICAL FIELD

The present disclosure pertains to oven appliances, and more particularly, to lighting for an oven door.

BACKGROUND

Oven doors typically have a viewing window to allow the contents of the oven to be viewed from the outside of the oven. Normally, while an item in the oven is cooking, the interior of the oven is not illuminated (other than by incidental visible light radiated by the heating elements). Many ovens provide an oven light to illuminate the oven interior during cooking. The oven light is usually turned on by a switch located on the oven console.

SUMMARY

The present disclosure is directed to lighting for a door of an oven or similar appliance that has a viewing window.

According to one aspect, an oven has a housing defining a cavity. The cavity includes at least one heating element configured to heat items placed in the cavity. A door is pivotably coupled to the housing. A window is supported by the door. A design is etched in the window. A first light source is positioned in the door. The first light source illuminates the design.

The oven may include a switch supported by the housing and configured to selectively activate the first light source. The oven may include a second light source positioned to illuminate the oven cavity. The oven may include a second switch supported by the housing and configured to selectively activate the second light source. The first light source may illuminate an area external to the oven without illuminating the oven cavity.

According to another aspect, an oven door includes a panel and a window supported by the panel. The window includes an etched portion and a non-etched portion. A heat-resistant material is positioned between the window and the panel to insulate the window from heat. A light source is positioned adjacent an edge of the window and is selectively activatable to illuminate a design etched into the etched portion of the window.

The light source may be mounted underneath a bottom edge of the window. The light source may be configured to emit light in one or more colors. The design may include one or more alphanumeric elements. The design may include one or more non-alphanumeric elements. The design may include a combination of alphanumeric and non-alphanumeric elements.

The light source may be operably coupled to a switch. The switch may be coupled to the oven door.

The window may have a front surface and a back surface spaced from the front surface by a thickness, with the light source being sized to fit within the thickness. The back surface of the window may be heat-resistant.

The light source may include one or more light-emitting diodes. The one or more light-emitting diodes may be mounted perpendicularly to an edge of the window.

According to another aspect, a method of assembling an oven door includes positioning insulation adjacent a back panel. The back panel and the insulation are formed to include a window. The method also includes etching a first design into a first heat-resistant glass. The first heat-resistant glass is positioned adjacent the window. A light source is positioned adjacent an edge of the first heat-resistant glass. The light source is spaced from the back panel by at least the insulation.

The method may include receiving a request including a second design, etching the second design into a second heat-resistant glass, removing the first heat-resistant glass from the window, and positioning the second heat-resistant glass adjacent the window. The method may also include positioning the light source adjacent an edge of the second heat-resistant glass, where the light source is spaced from the back panel by at least the insulation.

BRIEF DESCRIPTION OF THE DRAWINGS

In the drawings, like reference numerals refer to corresponding parts in the several views. To facilitate explanation, elements shown in the figures are not necessarily drawn to scale and may or may not be drawn in proportionate size to one another.

DETAILED DESCRIPTION OF THE DRAWINGS

Figure 1:
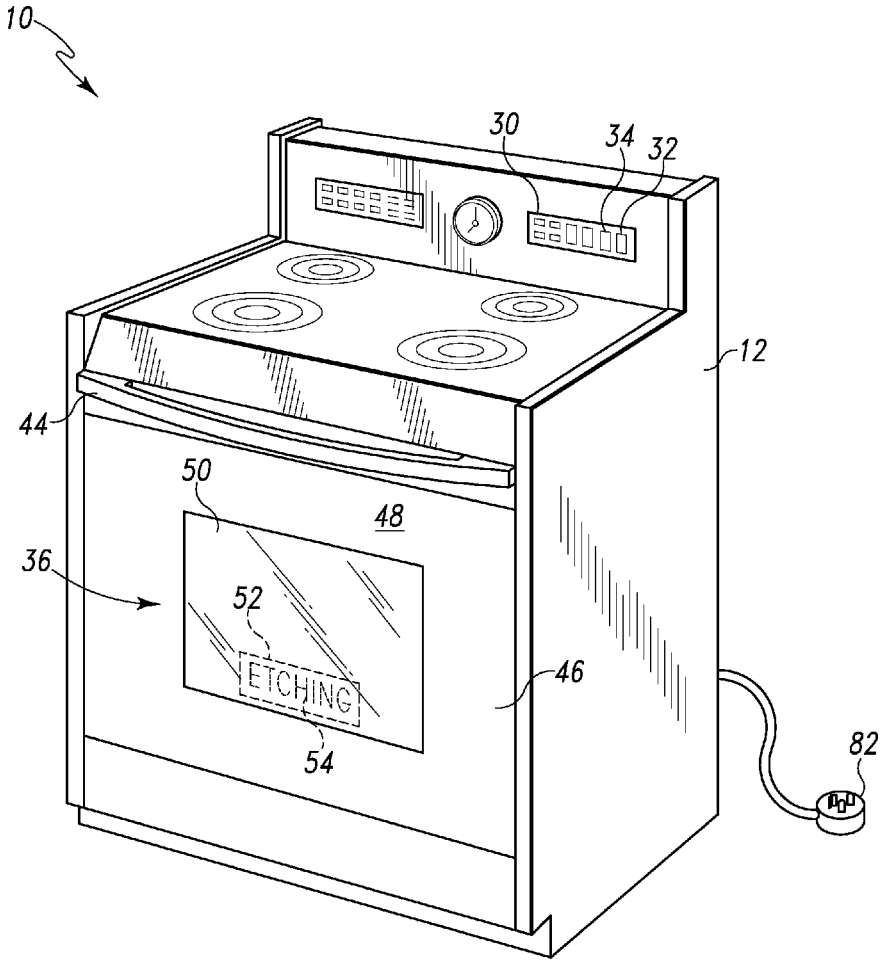
FIG. 1 is a perspective view of an exemplary oven having a lighting feature in the oven door.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Figure 2:
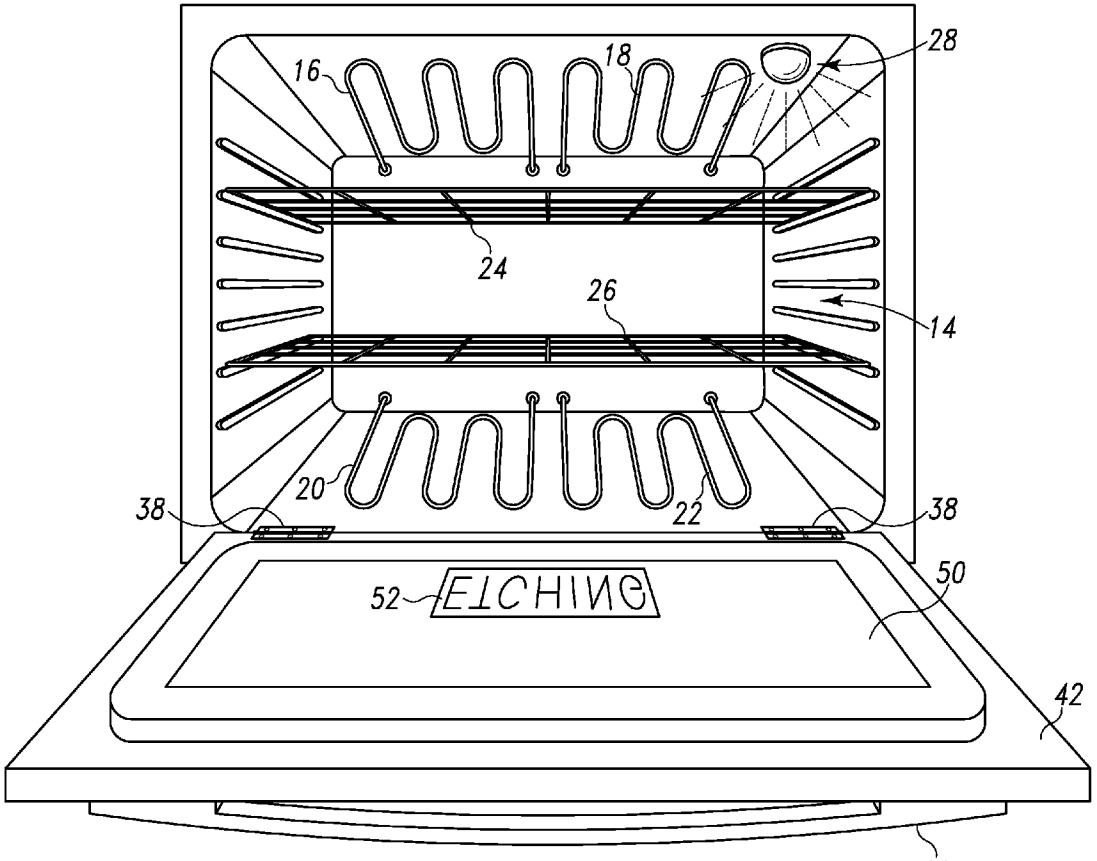
FIG. 2 is a partial perspective view of the oven of FIG. 1, with the oven door open.
Figure 3:
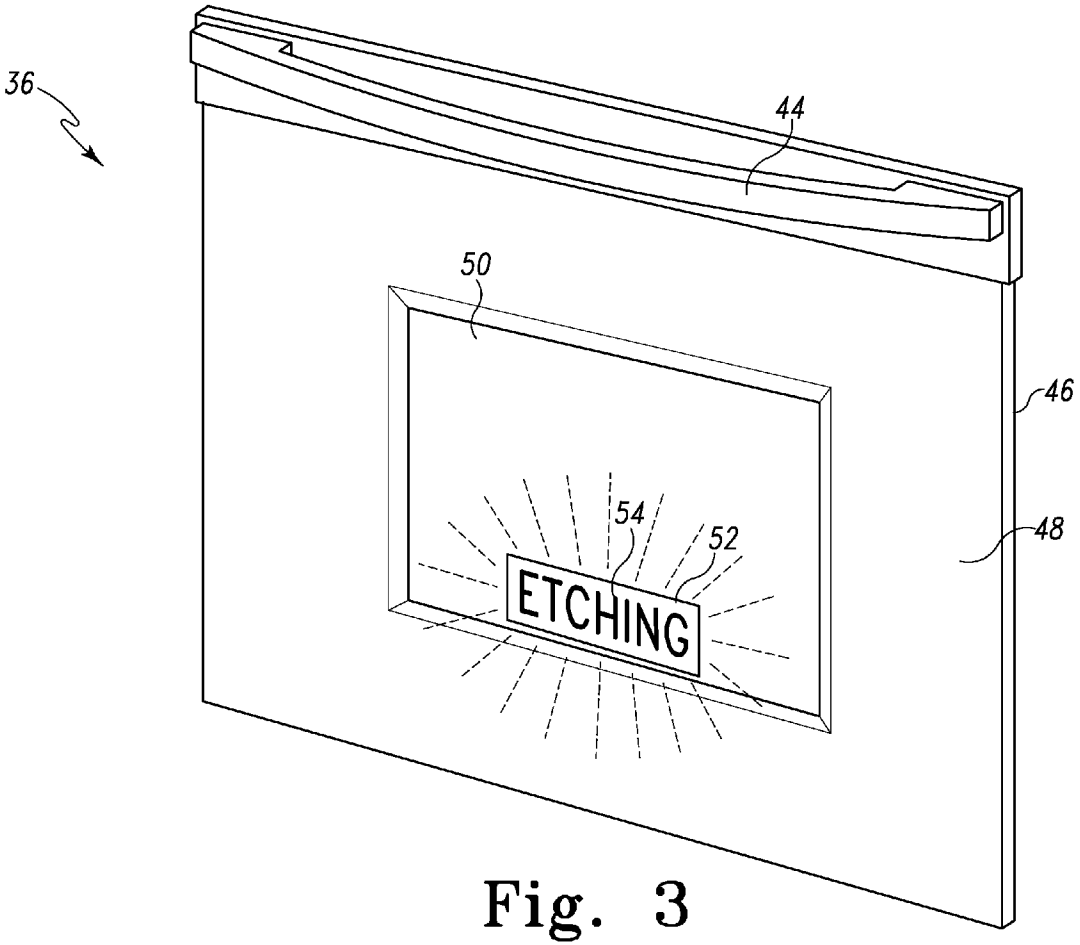
FIG. 3 is a front perspective view showing the oven door lighting feature in an illuminated mode.

Referring to FIGS. 1-2, there is shown an oven 10 having a housing 12, an oven door 36, and a console 30. The housing 12 defines a cavity 14. The oven 10 includes a number of heating elements 16, 18, 20, 22 to heat the cavity 14. A number of racks 24, 26 are spaced from the heating elements 16, 18 and supported by the side walls of the cavity 14 as shown. An oven light 28 is mounted to the housing 12 inside the cavity 14. The oven light 28 may be selectively activated by an oven light switch 32 to illuminate the cavity 14.

The oven door 36 is pivotably coupled to the housing 12 by a number of hinges 38 or similar coupling mechanisms. In general, the oven door 36 includes a back panel 42, a handle 44, a front panel 46, and a lighting feature 80.

The front panel 46 includes a masking 48 and a viewing window 50. The viewing window 50 includes an etched area 52 and a non-etched area outside of etched area 52. At least a portion of the viewing window 50 is transparent. The masking 48 is generally non-transparent. The front panel 46 is typically constructed of heat-resistant glass. In the illustrated embodiment, the back side of the front panel 46, i.e., the side that faces the cavity 14, typically has a heat-resistant coating.

The lighting feature 80 includes the etched area 52, a light source 56, and an oven door light switch 34. The lighting feature 80 selectively illuminates the etched area 52. Typically, the lighting feature 80 does not illuminate the cavity 14. Also, the lighting feature 80 typically does not illuminate the other, non-etched areas of the viewing window 50.

The lighting feature 80 may be configured to illuminate an area external to the oven 10; to provide a night light, for example. The configuration of the lighting feature 80 to include any of the aforementioned capabilities involves selecting one or more lights 58 that have appropriate intensity, brightness, wattage, and/or other characteristics that are suitable to provide the desired amount and brightness of the light. A wide variety of such lights 58 are commercially available, as will be understood by those skilled in the art.

The etched area 52 includes a design 54. The design 54 is etched or otherwise formed or inscribed in the window 50 so that it refracts light or otherwise appears illuminated when the light source 56 is activated. In the illustrated embodiment, an acid etching technique is used. In other embodiments, laser or other suitable techniques may be used. While the etched area 52 is shown in the drawings as being located along the bottom portion of the window 50, the etched area 52 may be located anywhere within the transparent region of the front panel 46. Also, more than one etched area 52 may be provided.

The design 54 may include alphanumeric characters, non-alphanumeric characters, symbols, figures, other artwork or a combination of any of the foregoing. For example, the design 54 may include the oven manufacturer's name, logo or trademark. The design 54 may alternatively or in addition be created or modified upon request. For instance, the design 54 may include a name, slogan, motto, saying, logo or other artwork selected by a person purchasing or using the oven 10.

Figure 4:
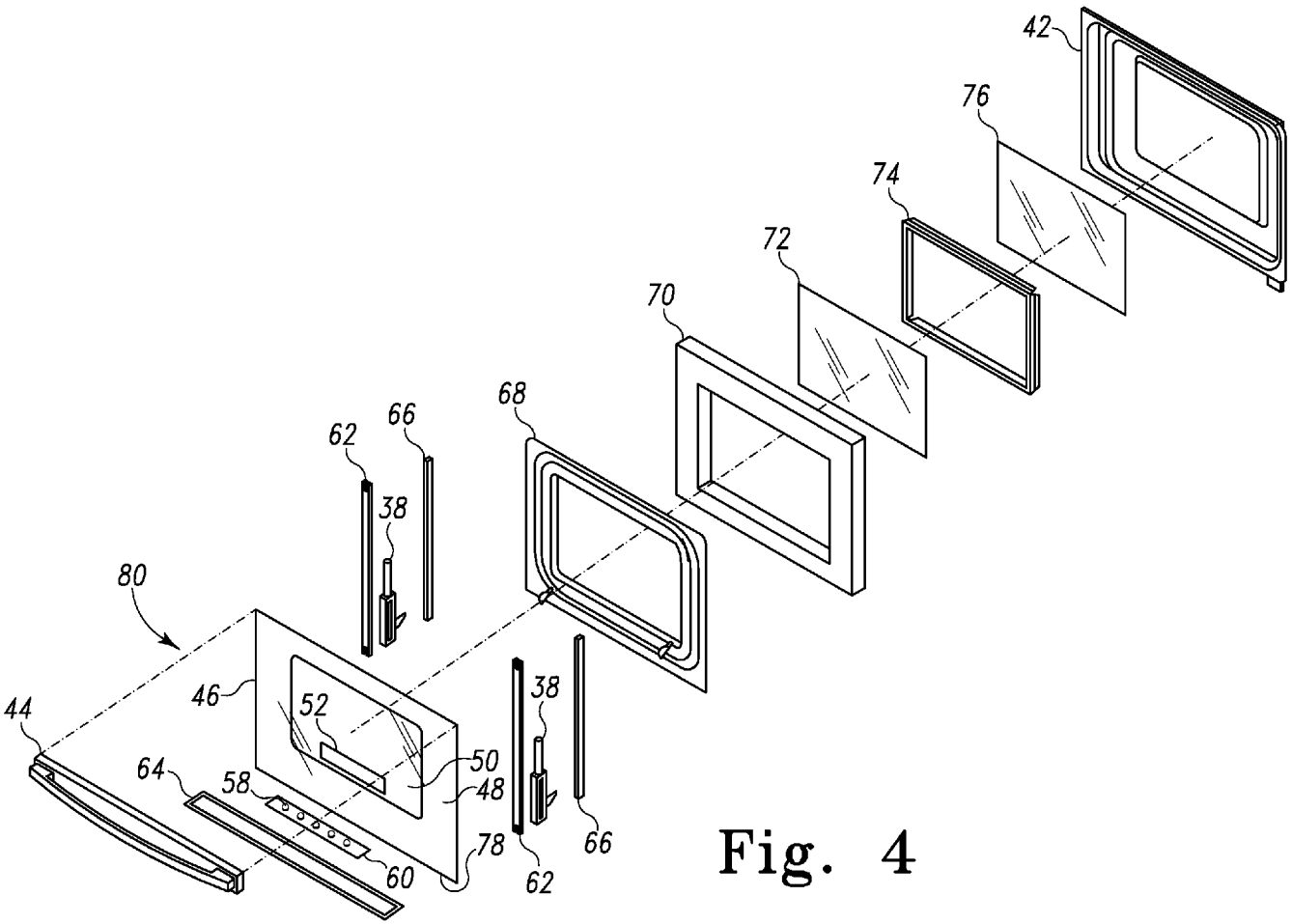
FIG. 4 is an exploded perspective view showing elements of the assembly of the oven door including the lighting feature.

The light source 56 is positioned to direct light into the etched area 52. As best shown in FIG. 4, the light source 56 includes a light bar 60 and at least one light 58 mounted to the light bar 60. The light bar 60 is mounted adjacent to an edge 78 of the front panel 46 so that light generated by the lights 58 passes through the front panel 46.

For example, in the illustrated embodiment, the light bar 60 is mounted to a bottom trim piece 64. While the light source 56 is shown in the drawings as positioned underneath the bottom side of the front panel 46, the light source 56 may be mounted adjacent any of the other sides of the viewing panel 46 so long as the etched area 52 is illuminated.

Typically, when the etched area 52 is illuminated, the non-etched areas of the front panel 46 and the cavity 14 are substantially non-illuminated. In addition, multiple light bars 60 may be provided as needed to illuminate the etched area or areas 52.

In the illustrated embodiment, each light 58 includes a light-emitting diode (LED), which is mounted perpendicularly to the light bar 60. However, other suitable sources of light, such as neon or fluorescent lights, may be used as long as they may be used to illuminate the etched area 52. Each light 58 may be configured to generate any color or combination of colors of light in the visible spectrum that may be desired.

The lights 58 are connected to electrical circuitry located in the light bar 60. The electrical circuitry of the light bar 60 is mounted to a circuit board. The circuit board and electrical circuitry are protected by a plastic housing. The light bar electronics are connected to a source of electrical current by insulated wiring that is typically routed through one or more of the hinges 38, 40.

The light source 56 is selectively activatable by an oven door light switch 34. In the illustrated embodiment, the oven door light switch 34 is located on the console 30. In other embodiments, the oven door light switch 34 may be provided in the oven door 36. For example, the oven door light switch 34 may be contact sensitive so that the lighting feature 80 is activated when the oven door 36 is shut. As another example, the oven door light switch 34 may contain a photosensitive sensor, so that the lighting feature 80 is automatically activated when lighting is low in the kitchen or other area around the exterior of the oven 10.

FIG. 4 is a simplified depiction of the assembly of the oven door 36. The handle 44 is attached to the front panel 46 via adhesive, screws or other suitable fasteners. The plastic housing of the light bar 60 is coupled to the bottom trim piece 64 by adhesive, screws, or other suitable fasteners.

The bottom trim piece 64 is typically made of plastic. The bottom trim piece 64 supports the front panel 46 and closes the bottom side of the oven door 36.

The front panel 46 is mounted to the brackets 62 by an adhesive, screws, or other suitable fasteners. Screws or other suitable fasteners couple the brackets 62 and the hinges 38 to the back panel 42. The brackets 62 are typically made of galvanized or cold roll metal. The hinges 38 include metal springs, cams, or other suitable mechanisms configured to pivotably open and close the oven door 36.

The side trim pieces 66 are typically made of plastic and are configured to close the sides of the oven door 36. The retainer 68 is attached to the back panel 42 via screws or other suitable fasteners. The retainer 68 is typically made of galvanized metal and is configured to support the insulation 70.

The insulation 70 is typically made of fiberglass and is configured to fit within the retainer 68. The retainer 68 and the insulation 70 are sandwiched between the front panel 46 and the back panel 42. The retainer 68 and the insulation 70 each have an opening sized, shaped, and positioned to correspond to the size, shape and position of the viewing window 50.

The front panel 46 is typically made of a heat-resistant glass. In other embodiments, the front panel 46 may include a galvanized metal frame in which the viewing window 50 is mounted (i.e, in place of the masking 48).

The back panel 42 is typically made of cold-rolled, porcelainized metal.

The back panel 42 has an opening sized, shaped, and positioned to correspond to the size, shape and position of the viewing window 50. The construction of the oven door 36 generally protects the lighting feature 80 from heat generated by heating elements 16, 18, 20, 22.

An optional glass pack including glass windows 72, 76 separated by a spacer 74 is shown in FIG. 4, although it is not required. Typically, such a glass pack is provided in ovens that have a self-cleaning feature. The windows 72, 76 and the spacer 74 are sandwiched between the insulation 70 and the back panel 42 to provide insulation from the additional heat generated when the self-cleaning feature is activated. The windows 72, 76 are typically treated with a heat-resistant coating on both sides. The spacer 76 is typically made of a galvanized metal and has an opening in which the windows 72, 76 are supported.

The console 30 provides controls for operating the oven 10, including the oven light switch 32 and the oven door light switch 34. These and other controls may take the form of membrane switches, toggle switches, buttons, dials, slides or other suitable control mechanisms. Such controls are in electrical communication with a source of electricity, and with the item (e.g., oven light, over door light) controlled thereby. Typically, insulated wiring or similar conductor is used for this purpose.

Electricity is normally supplied by connecting the oven 10 to an external power source, e.g., a wall outlet, by a plug 82. However, one or more of the controls may be powered by an alternative source. For example, the oven door lighting feature 80 and/or other features may be operably connected to a battery or other backup source to remain operational if the main power source becomes unavailable.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

For example, although a range oven is depicted in the drawings, it will be understood by those of skill in the art that the present invention is applicable to wall ovens, double ovens, microwave ovens, toaster ovens, convection ovens, commercial ovens, and similar appliances that have doors with viewing windows. In addition, the present disclosure is supplemental to and independent of the actual configuration of the interior cavity of such appliances.

There is a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. A method of assembling an oven door, comprising:

positioning insulation adjacent a back panel, the back panel and the insulation being formed to include an opening, etching a first design into a first heat-resistant window, positioning the first heat-resistant window adjacent the opening, positioning a light source adjacent an edge of the first heat-resistant window, the light source being spaced from the back panel by at least the insulation, receiving a request including a second design, etching the second design into a second heat-resistant window, removing the first heat-resistant window from the opening, and positioning the second heat-resistant window adjacent the opening.

2. The method of claim 1, comprising positioning the light source adjacent an edge of the second heat-resistant window, the light source being spaced from the back panel by at least the insulation.

* * * * *